United States Patent [19]

Boxhammer

[11] Patent Number: 4,742,900

[45] Date of Patent: May 10, 1988

[54] CONVERTIBLE SUITCASE TO BE TRANSFORMED INTO A SEATING OR LYING PIECE OF FURNITURE

[76] Inventor: Paul Boxhammer, Mauerkircherstrasse 168, 8000 Munich, Fed. Rep. of Germany

[21] Appl. No.: 90,587

[22] PCT Filed: Nov. 13, 1986

[86] PCT No.: PCT/EP86/00655

§ 371 Date: Jul. 10, 1987

§ 102(e) Date: Jul. 10, 1987

[87] PCT Pub. No.: WO87/02901

PCT Pub. Date: May 21, 1987

[30] Foreign Application Priority Data

Nov. 14, 1985 [DE] Fed. Rep. of Germany ..... 3540436

[51] Int. Cl.[4] ..... A47C 17/82; A47C 19/22; A45F 4/00

[52] U.S. Cl. ..... 190/2; 190/8; 297/17; 5/503

[58] Field of Search ..... 190/2, 8, 11; 5/503; 297/17, 118

[56] References Cited

U.S. PATENT DOCUMENTS

| | | | |
|---|---|---|---|
| 1,005,709 | 10/1911 | Jackson | 190/2 |
| 1,420,782 | 6/1922 | Suski | 190/2 |
| 3,516,523 | 6/1970 | Pemberton, Jr. | 190/11 |
| 4,132,295 | 1/1979 | Hochfelsen | 190/102 |

FOREIGN PATENT DOCUMENTS

| | | | |
|---|---|---|---|
| 141740 | 6/1903 | Fed. Rep. of Germany . | |
| 193200 | 12/1907 | Fed. Rep. of Germany . | |
| 1957062 | 6/1974 | Fed. Rep. of Germany . | |
| 329476 | 5/1903 | France | 190/2 |
| 240085 | 9/1925 | United Kingdom . | |

*Primary Examiner*—William Price

[57] ABSTRACT

The suitcase (10) comprises two suitcase shells (12,14) which are hingedly connected to each other and adapted to be locked in folded condition. The suitcase (10) houses a head portion (16) and a foot portion (18) which are pivotably connected by double-joint hinges (22 and 24, respectively) to a narrow sidewall of the lower suitcase shell (12) such that they can be unfolded into a position for use when the suitcase is open. The two suitcase shells (12,14) can be folded together and locked even in this position for use. When the suitcase (10) is closed, the upper outside surface of the upper suitcase shell (14) presents a surface (20) to sit or lie on. The unfolded head and/or foot portion (16,18) is prevented from being swung back up to close to the lying surface (20) by an abutment surface (26,28) formed at the upper suitcase shell (14). The suitcase (10) thus transformed into a seating or lying piece of furniture, therefore, cannot be changed back by an unauthorized person into anything similar to a normal suitcase and consequently cannot be carried off inconspicuously.

2 Claims, 5 Drawing Sheets

CONVERTIBLE SUITCASE TO BE TRANSFORMED INTO A SEATING OR LYING PIECE OF FURNITURE

The invention relates to a convertible suitcase to be transformed into a seating or lying piece of furniture, comprising two hingedly connected suitcase shells which can be locked in folded condition and at least one head or foot portion housed in the suitcase and pivotably connected to one of the suitcase shells so that it can be unfolded when the suitcase is open.

A known suitcase of this kind (DE-B 1 957 062) which can be converted into a bed for children has its two suitcase shells, which, in unfolded state, form a flat lying surface presented by the inner surfaces of their bottoms, the lying surface being limited at its narrow sides by a head or foot portion, respectively, swung vertically upwardly. Handles are pivotably connected to the outside of both suitcase shells. When the suitcase is closed, they serve as carrying handles, and when the bed is unfolded, they serve as support handles being connected by crank arms to the head or foot portion, respectively, such that each handle can be pivoted only together with the associated head or foot portion. Furthermore, side portions are pivotably connected to the head portion, extending across half the length of the bed and adapted to be connected to a corresponding side portion pivoted at the foot portion, whereby any unintentional collapse of the bed is prevented. In folded condition, the two suitcase shells can be locked together by a closure. Yet when the bed is erected, unauthorized folding cannot be prevented. Only in folded condition may the suitcase be used as a container for storing things.

For some time already, a demand has been known for a suitcase convertible into a lying piece of furniture to be useful as a lockable container for keeping things even when in use as a lying piece of furniture. A known suitcase meeting this demand (DE-A-141 740) has two suitcase shells which can be totally separated in unfolded condition and are each closed by a lid provided with a lock. An end portion each of a fabric web is attached to the two lids, and the fabric web can be extended between the two separated suitcase shells and kept tight by braces adapted to be fixed to the two suitcase shells and slid into seams along the edges of the fabric web. Again, safety measures against any unintended folding of the lying piece of furniture made from the suitcase are missing so that it is no problem for a thief to carry off unnoticed the folded bed which has been reconverted into a normal suitcase, plus any other contents of the suitcase.

It is the object of the invention to develop a convertible suitcase to be transformed into a seating or lying piece of furniture of the kind specified initially such that it is useful as a lockable container for storing things, even with the head portion and also the foot portion, if any, in a position for use and that it cannot be reconverted by an unauthorized person into a suitcase which looks normal and could be lifted inconspicuously.

This object is met, in accordance with the invention, in that the two suitcase shells are adapted to be folded together and locked even if the head and/or foot portion is unfolded, with the suitcase closed, the outside surface of one suitcase shell remote from the other suitcase shell presents a seating or lying surface, and the unfolded head and/or foot portion is prevented from being swung back all the way to the lying surface by an abutment surface formed at one of the suitcase shells.

When the head portion and the foot portion, if any, are in position for use, the authorized user of a suitcase according to the invention may avail himself of the suitcase for storing any basic commodities which are likely to be stolen, and he may lock the same if he intends to leave it unattended for some time, for instance, at a beach to go swimming. The interlocked suitcase shells of the closed suitcase retain the head and foot portions in their unfolded position for use in such manner that they may be swung into a different position for use, at best, but not into the suitcase, not even back against the outer surface of the suitcase which is predetermined as seating or lying surface. This means that the two interlocked suitcase shells together with the unfolded head portion and foot portion, if any, constitute such a bulky overall structure that it cannot be lifted inconspicuously, nor can it be stored in the trunk of a customary passenger car. When the head and foot portions are unfolded and together with the outside surface of the one suitcase shell form a lying surface of the usual dimensions of a camp bed, it should hardly be possible also to get it into the passenger compartment of a usual car. The suitcase according to the invention and its contents thus are highly protected against theft.

In accordance with a preferred further development of the suitcase according to the invention the pivotable connection of the head and/or foot portion to one of the suitcase shells is by double hinges. This permits rather big head and foot portions to be received in a suitcase having a given inside space and, conversely, it means that a lying piece of furniture of the usual length of, for example, 200 cm, can be made out of a rather small suitcase having a maximum outer dimension of about 68 cm.

An embodiment of the invention will be described further below, with reference to diagrammatic drawings, in which.

Figure 1:
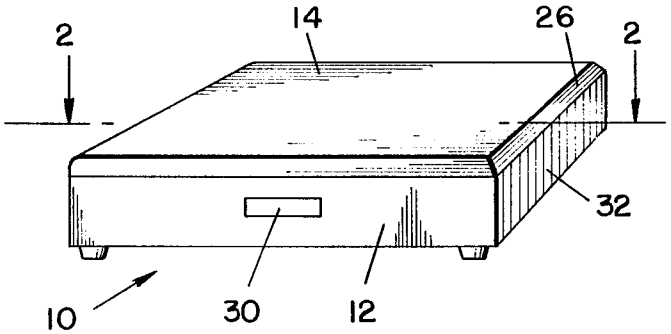
FIG. 1 is an oblique view of a closed suitcase according to the invention.
Figure 2:
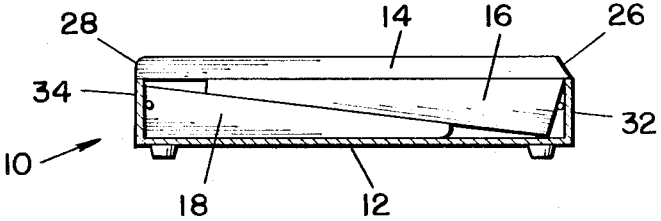
FIG. 2 is a side elevation of the suitcase, shown partly as longitudinal section II—II in FIG. 1.

The suitcase 10 shown looks like a commercially available piece of travelling luggage when it is closed, as shown in FIG. 1, rather than turned into a piece of furniture to lie on. It comprises a lower suitcase shell 12 and an upper suitcase shell 14 which is flatter and like a lid. They are made in conventional manner in one piece each of a material resistant to fracture, such as glass fiber reinforced plastics. At one long side, they are connected together by hinges (not shown). The closed suitcase 10 according to FIG. 1 contains a head portion 16 and a foot portion 18, as may be seen in FIG. 2. They both are of wedge shape and likewise may be made of glass fiber reinforced plastic material.

The top side of the upper suitcase shell 14 constitutes a seating or lying surface 20 which may be extended by the head portion 16 and/or the foot portion 18. To this end the head portion 16 is connected to a narrow side of the lower suitcase shell 12 by one elongated double joint hinge 22 or a plurality of such hinges which are of corresponding shorter length, as may be taken particularly from FIG. 7. Similar hinges 24 connect the foot portion 18 to the opposed narrow side of the lower suitcase shell 12.

Figure 3:
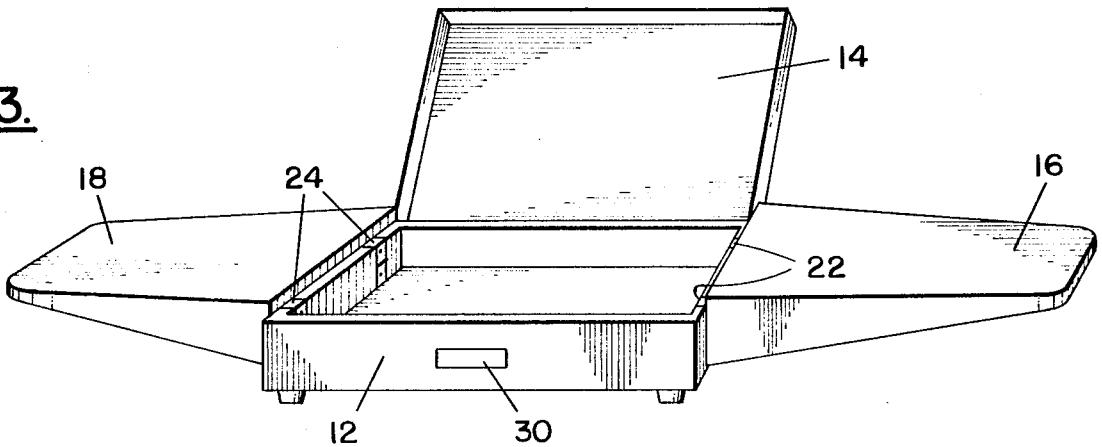
FIG. 3 is an oblique view, corresponding to FIG. 1, of the suitcase in unfolded condition while being converted into a lying piece of furniture.
Figure 4:
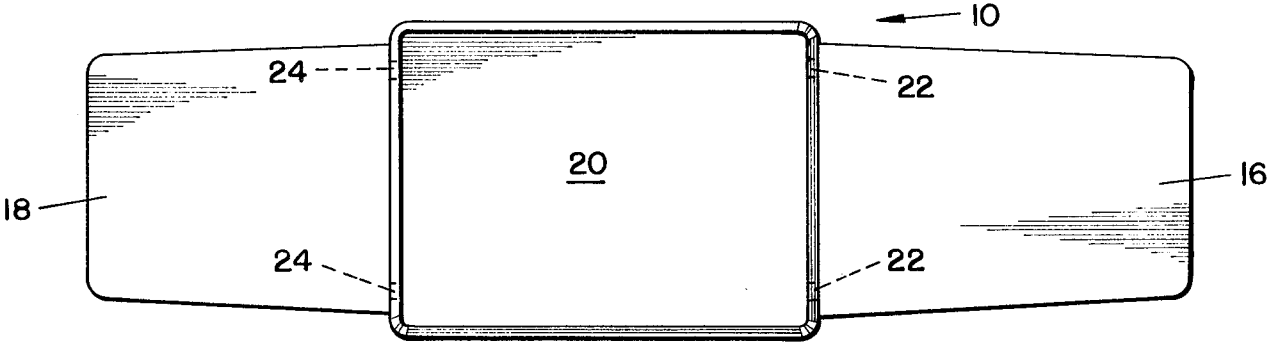
FIG. 4 is a top plan view of the suitcase in a first position for use as a lying piece of furniture.
Figure 5:
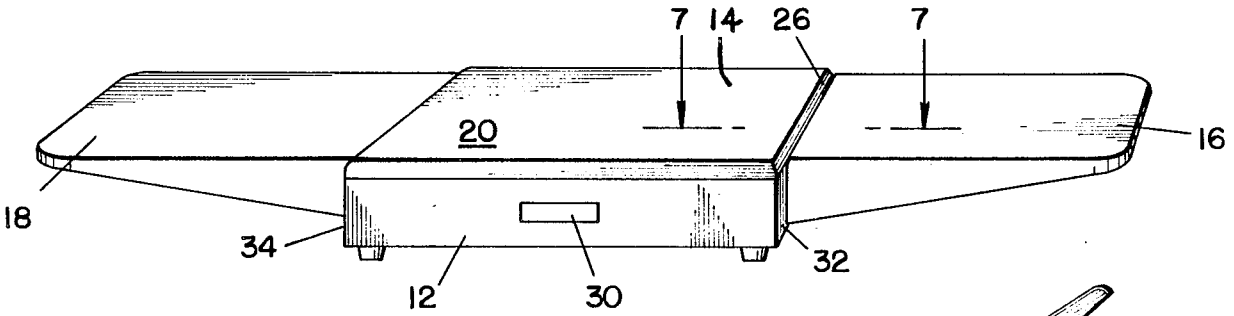
FIG. 5 is an oblique view of the same position for use.

Once the head portion 16 is swung out from inside the suitcase 10, as shown in FIG. 3, and the suitcase shells 12 and 14 have been folded on top of each other again, the head portion 16 may be swung back by no more than an angle of about 80° from the horizontal position for use illustrated in FIGS. 3 to 5 and 7. This angle is limited by the fact that an inclined abutment surface 26 for the head portion 16 is formed at the narrow side of the upper suitcase shell 14. A similar abutment surface 28 for the foot portion 18 is provided at the opposite narrow side of the upper suitcase shell 14. However, in the embodiment shown, it is designed such that it practically prevents any swinging back worth mentioning of the foot portion 18.

As usual, any unintentional unfolding of the suitcase 10 may be prevented by closing a lock 30 which is integral with a carrying handle of the suitcase 10 in the embodiment shown. If the lock is closed when the suitcase 10 is converted into a lying piece of furniture, as shown in FIGS. 4 to 7, no unauthorized person may reconvert it into the normal looking suitcase 10 of FIG. 1.

The two narrow sides of the lower suitcase shell 12 each include a support face 32 and 34, respectively, for the fully unfolded head and foot portions 16 and 18 in order to keep the hinges 22 and 24 substantially free of loads caused by the user's weight.

Figure 7:
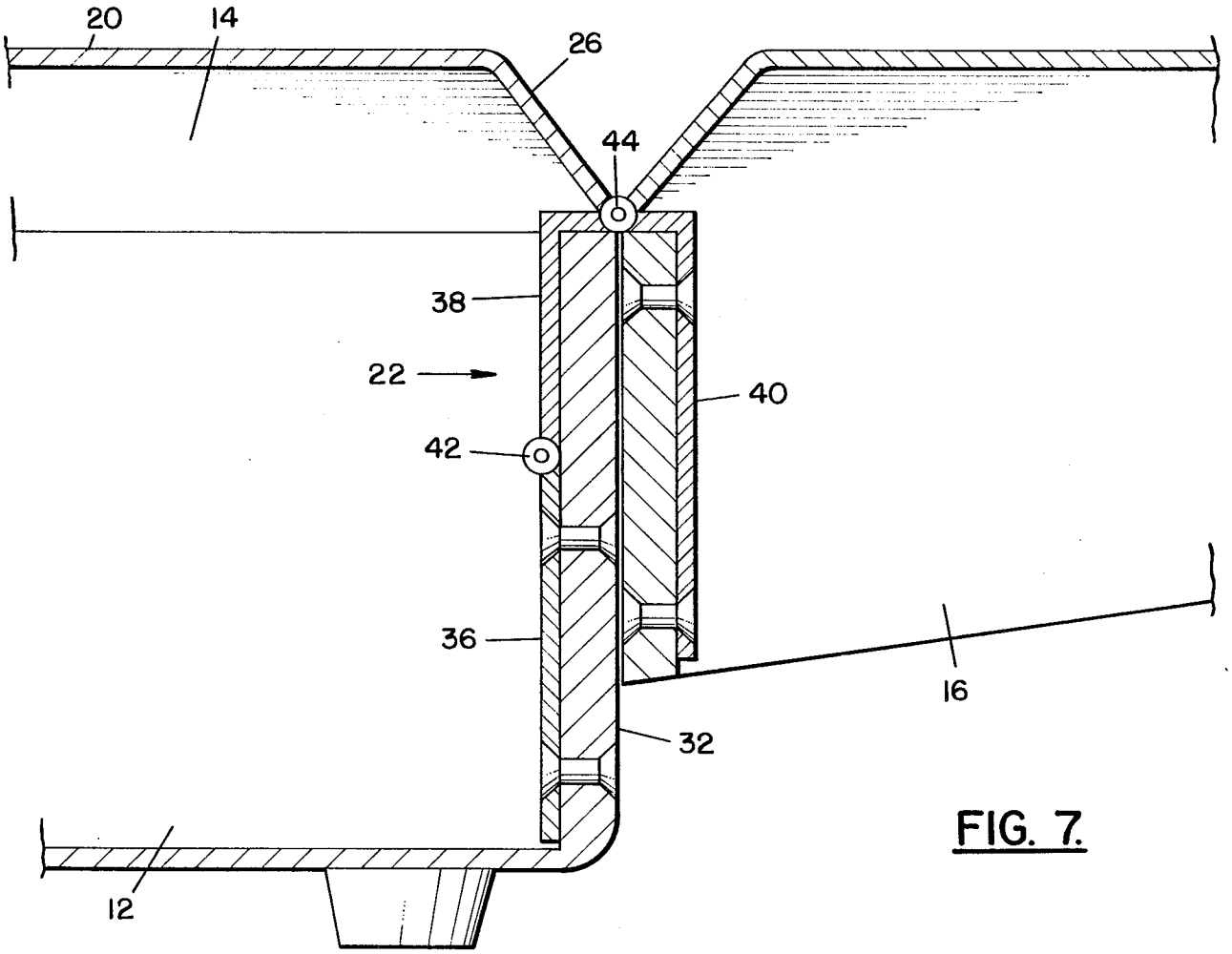
FIG. 7 is the part section VII—VII of FIG. 5.

As shown in FIG. 7, each of the hinges 22 and 24 has three legs 36, 38, and 40 of which the first leg 36 is riveted to the associated narrow sidewall of the lower suitcase shell 12, the second leg 38 is pivotably connected to the first leg 36 by a first hinge pin 42 and to the third leg 40 by a second hinge pin 44, but not fastened anywhere else, and the third leg 40 is riveted to the associated head portion 16 or foot portion 18. The two hinge pins 42 and 44 of each hinge 22 and 24 are parallel to the upper edge of the corresponding sidewall of the lower suitcase shell 12. The first hinge pin 42 lies somewhat above half the height of the respective sidewall, while the second hinge pin 44 lies at the upper edge of the respective sidewall when the associated head portion 16 or foot portion 18 is in position for use.

At least one detent plate 46 of circular sector shape is supported on the second hinge pin 44 or an axis aligned with the same in order that the head portion 16 may be retained in various positions for use within its pivoting range which is defined by the abutment surface 26 in upward direction and by the support face 32 in downward direction when the suitcase shells 12 and 14 are folded together. The detent plate may be pivoted completely into the head portion 16 when the latter is to adopt its lowermost position for use shown in FIGS. 3 to 5 and 7.

Figure 6:
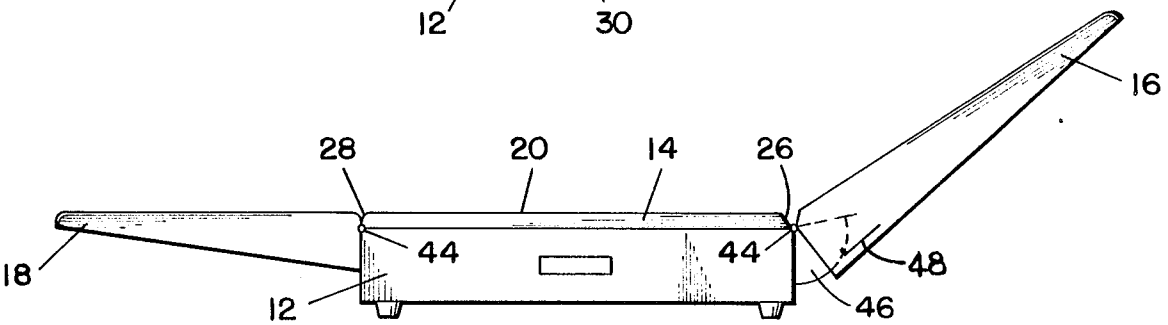
FIG. 6 is a side elevation of a second position for use.

However, if the head portion 16 is swung into a higher position for use, the or each corresponding detent plate 46 is pivoted partly out of the head portion 16 by its own weight or by minor spring pressure, as shown in FIG. 6. Instead of directly supporting head portion 16 as before, therefore, it now takes care of its indirect support on support face 32. The power transmission this requires between the head portion 16 and the detent plate 46 is generated by a pawl 48 which becomes locked, under its own weight or by minor spring pressure, in a sawtooth-like serration formed at the outer circumference of the detent plate 46.

Various embodiments of such click-stop devices which may be releasable directly by hand or indirectly by upward swinging movement of the head portion 16 are known in connection with folding beds and, therefore, not shown here.

FIGS. 8 to 13 illustrate another embodiment of a suitcase according to the invention substantially corresponding to the one presented in FIGS. 1 to 7. However, in the case of the embodiment shown in FIGS. 8 to 13 the suitcase 10, the head portion 16, and the foot portion 18 are made of aluminum rods or tubes across which a highly stable plastic material is stretched which is resistant especially against knife cuts. Such a suitcase can be manufactured at low cost. Apart from the specific design comprising a tubular aluminum frame and a tear-resistant covering, the embodiment illustrated in FIGS. 8 to 13 corresponds to the embodiment described above so that reference may be had to the description thereof.

Figure 8:
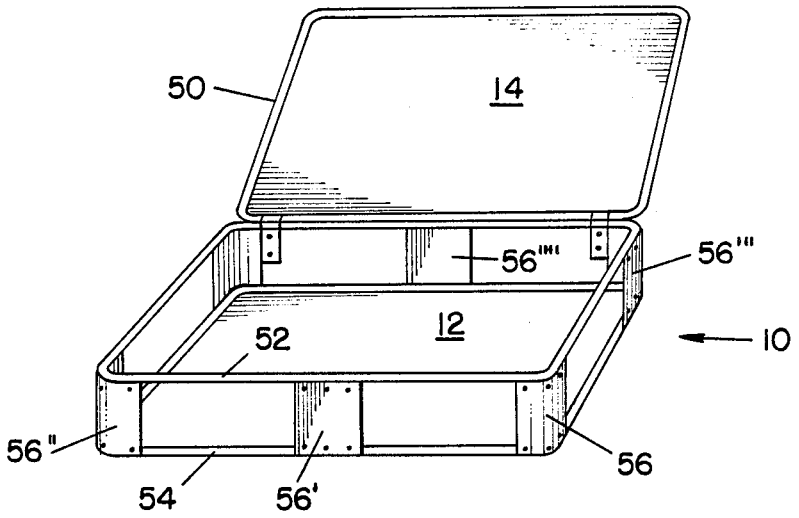
FIGS. 8 to 13 are views of another embodiment of a suitcase according to the invention.

As shown in FIG. 8, the suitcase 10 is made up of aluminum tubes 50,52,54. Light plates of aluminum 56,56',56'',56''', and 56'''' are fastened between the tubes 52 and 54 of suitcase shell 12.

Figure 9:
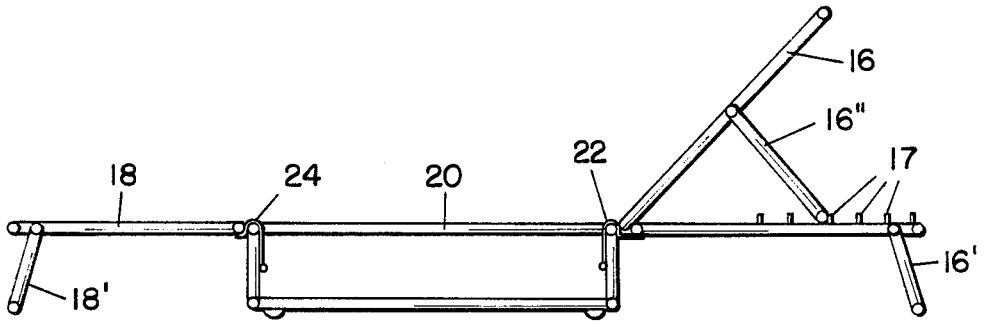

FIG. 9 shows the suitcase with an unfolded foot portion 18 and an unfolded head portion 16. The foot portion 18 includes a pivotably connected support 18'. The head portion 16 is provided accordingly with a pivotably connected support 16'. As follows from FIG. 9, the inclination of the head portion 16 may be varied by a per se known support 16'' which engages in different steps 17 so that the angle of inclination is selectively variable.

Figure 10:
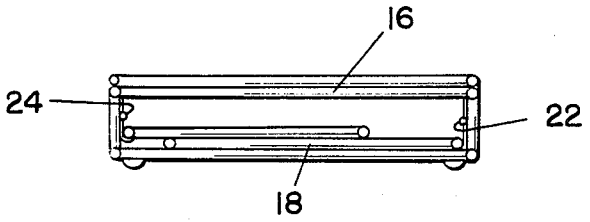

FIG. 10 shows the suitcase in folded and locked condition.

Figure 11:
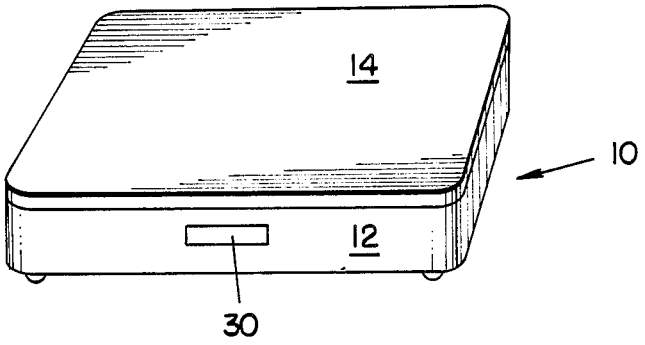
Figure 12:
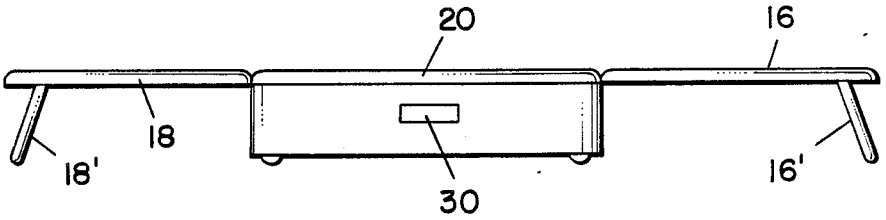
Figure 13:
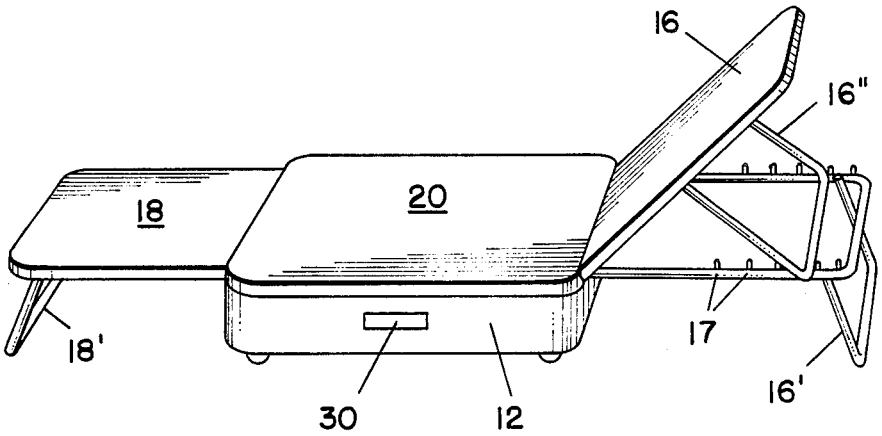

FIGS. 11 to 13 illustrate the covering of the suitcase according to FIGS. 8 to 10 with a stable, tear-resistant cloth, for instance glass fiber reinforced plastic material. The covering likewise may be reinforced by thin metal filaments.

What is claimed is:

1. A convertible suitcase (10) to be transformed into a seating or lying piece of furniture, comprising two hingedly connected suitcase shells (12, 14) which can be locked in folded condition and at least one head or foot portion (16,18) housed in the suitcase (10) and pivotably connected to one of the suitcase shells (12,14) so that it can be unfolded when the suitcase (10) is open, characterized in that

- the two suitcase shells (12,14) are adapted to be folded together and locked even if the head and/or foot portion (16,18) is unfolded, with the suitcase (10) closed, the outside surface of one suitcase shell (14) remote from the other suitcase shell (12) presents a seating or lying surface (20), and
- the unfolded head and/or foot portion (16,18) is prevented from being swung back all the way to the lying surface (20) by an abutment surface (26,28) formed at one of the suitcase shells (12,14).

2. The suitcase as claimed in claim 1, characterized in that the pivotable connection of the head and/or foot portion (16,18) to one of the suitcase shells (12,14) is by double hinges.

* * * * *